US005489764A

United States Patent [19]

Mannuss et al.

[11] Patent Number: 5,489,764

[45] Date of Patent: Feb. 6, 1996

[54] RADIANT HEATING COOK-TOP WITH BIASED TEMPERATURE SENSOR

[75] Inventors: Siegfried Mannuss, Sternenfels; Eugen Wilde, Knittlingen, both of Germany

[73] Assignee: E.G.O. Electro-Gerate Blanc u Fischer, Oberderdingen, Germany

[21] Appl. No.: 314,575

[22] Filed: Sep. 28, 1994

Related U.S. Application Data

[63] Continuation of Ser. No. 974,660, Nov. 12, 1992, abandoned.

[30] Foreign Application Priority Data

Nov. 12, 1991 [DE] Germany ..... 9113992 U

[51] Int. Cl.[6] ..... H05B 3/74; F24C 7/04

[52] U.S. Cl. ..... 219/464; 219/449

[58] Field of Search ..... 219/443–468

[56] References Cited

U.S. PATENT DOCUMENTS

| | | | |
|---|---|---|---|
| 3,042,783 | 7/1962 | Mertler | 219/449 |
| 3,995,141 | 11/1976 | Vieau et al. | 219/464 |
| 4,214,150 | 7/1980 | Cunningham | 219/452 |
| 4,241,289 | 12/1980 | Bowling | 219/450 |
| 4,350,875 | 9/1982 | McWilliams . | |
| 4,419,023 | 12/1983 | Hager, Jr. | 374/179 |
| 4,633,238 | 12/1986 | Goessler et al. . | |
| 4,665,307 | 5/1987 | McWilliams | 219/449 |
| 4,710,611 | 12/1987 | Axelson | 219/449 |
| 4,770,545 | 9/1988 | Takada et al. | 219/450 |
| 4,810,857 | 3/1989 | Goessler . | |
| 4,845,340 | 7/1989 | Goessler et al. . | |
| 4,855,572 | 8/1989 | Wallgren et al. | 219/449 |
| 5,208,574 | 5/1993 | Mannuss et al. | 337/394 |
| 5,393,958 | 2/1995 | Gross et al. | 219/464 |
| 5,420,398 | 5/1995 | Petri et al. | 219/448 |

FOREIGN PATENT DOCUMENTS

| | | | |
|---|---|---|---|
| 7612737 | 10/1976 | Germany . | |
| 2627373 | 12/1977 | Germany . | |
| 2806369 | 8/1978 | Germany . | |
| 2839161 | 3/1980 | Germany . | |
| 3536981 | 4/1987 | Germany . | |
| 8706277 | 6/1987 | Germany . | |
| 8905879 | 5/1989 | Germany . | |
| 3908600 | 9/1990 | Germany . | |
| 2011769 | 7/1979 | United Kingdom . | |
| 2069300 | 8/1981 | United Kingdom . | |
| 2093320 | 8/1982 | United Kingdom | 219/464 |
| 2137188 | 10/1984 | United Kingdom . | |
| 2229615 | 9/1990 | United Kingdom . | |

*Primary Examiner*—John A. Jeffery
*Attorney, Agent, or Firm*—Quarles & Brady

[57] ABSTRACT

In a radiant heating unit the temperature sensor (30) of a temperature limiter (29) extends over only part of the diameter of the heating field (17) in which the radiation heaters (13) are located. The temperature sensor is so constructed and/or mounted, that it exerts a pressure on the mounting support (44), e.g. in the form of a projecting member of the insulator (7), which is, e.g., located in the center of the heater. Thus, it keeps the insulation under a certain pretensioning pressure and it is simultaneously prevented that it is raised upwards and comes too close to the heated plate.

17 Claims, 2 Drawing Sheets

RADIANT HEATING COOK-TOP WITH BIASED TEMPERATURE SENSOR

This is a continuation of application Ser. No. 07/974,660 filed Nov. 12, 1992, now abandoned.

FIELD OF THE INVENTION

The invention relates to a radiant heating unit, such as can, e.g., be used as a hotplate, oven or other heating means, in order to deliver thermal radiation through a radiotransparent shield or plate.

BACKGROUND OF THE INVENTION

Heating units of the type of the invention and/or the shield thereof must be protected against overheating above a limiting temperature, e.g., by a protective switch operating in a temperature-dependent manner, so as to prevent heating on the glass ceramic top above several 100° C., e.g. approximately 600° C. (EP 288 915=U.S. Pat. No. 4,845,340). As such plates have a very low thermal mass and are scarcely conductive with respect to metallic materials, e.g. steel, the temperature sensor for such protection must be positioned in such a way that heat transfer thereto takes place by direct radiation, back radiation and/or a fluid or air in a substantially tightly closed or unventilated area, through which the thermal radiation is directed towards the shield. In order to achieve this the temperature sensor is appropriately positioned at least partly in that area, namely, between the emission side of at least one heater and the bearing plane for the shield. Due to the low conductivity of the plate or the heating unit it has hitherto been assumed that the temperature sensor must extend over the entire area associated with said heating means, so as to ensure an effective protection also in the case of local, narrowly defined overheating. Thus, the temperature sensor generally forms a rod traversing the area and whose ends engage in boundary walls thereof. Thus, for each size of a heating unit or such an area a different temperature sensor is required, which is disadvantageous as regards manufacture, stockkeeping and installation. There are also spacers between the temperature sensor, support body and plate.

DE 35 36 981 discloses a radiant heating unit, in which the temperature sensor does not extend over the entire heating field. Its end is provided with a mounting support, which is supported on the insulation of the support body and/or on the plate to be heated. The mounting support is interconnected between the sleeve forming the temperature sensor and its inner rod and is fixed in the insulation.

Shorter temperature sensors only extending over a short distance into the area or over the heating means, can admittedly be used for the operation of signal devices for heat indication purposes, but they function in a temperature range well below 100° C. (DE 26 27 373). Compared with an overheating protection, much lower demands are made thereon with respect to the thermal loading, the switching accuracy and the determination of the complete heating field. Thus, signal switches are not comparable with overheating switches, although the latter can additionally be constructed for the operation of a signal contact.

For an effective overheating protection, particularly of the shield or glass ceramic plate, it is also not possible to use temperature sensors located on the side of the heating means remote from the shield and which are, e.g., embedded in the insulating material support body (DE 36 22 415=U.S. 48 10 857). Thus, such temperature sensors are only suitable for monitoring a separately switchable marginal area of the heating means and for effective protection purposes it is necessary to have an additional temperature sensor located in said area.

In the case of mass hotplates protection can be provided by a temperature sensor, which is only located on one side of an axial plane of the cooking area positioned transversely thereto and on the side of the heating means remote from the heating or cooking surface, because in that location there is no need to fear local overheating due to the good thermal conductivity of the hotplate body (DE-U-76 12 737). This temperature sensor is also not heated to the same extent as the hotplate body and instead operates at a much lower temperature, which is derived from that of the hotplate body, so that it responds much more slowly than a temperature sensor in a radiant heating unit.

The radiant heating unit can have an overall heating field, which is subdivided into separately operable individual fields, so that through the choice of the number of simultaneously operated and interconnected individual fields it is possible to vary the operating size and shape of the heating field. The smallest operating shape or size, whose associated heating field must be put into operation in each operating state, must then have the said monitoring by the temperature sensor, so that the latter forms a thermally reactive working section with a longitudinal portion in the vicinity of said individual field. Longitudinal portions connecting thereto and possibly extending into adjacent heating fields must be thermally less reactive or non-reacting, in that they are insulated with respect to the radiation of the associated heating means, e.g. using at least one shield (DE 34 10 442=U.S. Pat. No. 4,633,238 and GB 22 29 615).

The invention solves the problems of the prior art by providing a radiant heating units of the aforementioned type, through which disadvantages of known constructions or of the described type are avoided and which, particularly with reliable overheating protection, ensures a simple construction and/or manufacture.

SUMMARY OF THE INVENTION

In the case of a lightweight, flat construction of the heating unit, its strength and in particular, thermal stability can be increased in that within the heating field and/or at a corresponding distance from the terminating end of the temperature sensor is provided at least one mounting support, which is permanently loaded by the temperature sensor with a tension which is transferred to a bottom area of the support body. If the temperature sensor is resilient in the area outside the heating field, but otherwise substantially rigidly connected to the edge of the flat dish-like support body, a frame or ladder-like stiffening structure is obtained, which extends from the central field of the support body to its outer circumference. This stiffening structure acts against any bulging of the support body bottom and the heating means arranged thereon as a result of thermal loading, so that the distance between the heating means and the temperature sensor, between the heating means and the bearing plane, i.e. the heated plate, as well as between the temperature sensor and the bearing plane always remains roughly constant. The tensioning means can be made up of a leafspring-like carrier of the temperature limiter, as well as a resilient tie rod, or of the inherent resilience of the temperature sensor or the support body edge.

Mounting supports are only appropriately provided at a significant distance from the circumference of the heating field. The distance from the mounting supports to the free end of the temperature sensor can be roughly 1/7 to 1/4 of the length of said longitudinal portion, with the mounting support also being extendable up to the end face of the temperature sensor or beyond it, and with the upper limit of the distance from Said end face being approximately 1/3 to 1/2 of the length.

According to the invention means are provided in order to arrange one or both ends of the thermally reactive working portion of the temperature sensor in a spaced manner within the heating field, which is also understood to mean an individual field according to the smallest operating shape, so that said working portion does not directly cover by direct radiation the entire associated heating field, but only a smaller part of the diameter thereof. In particular in the case of adequate sealing of the associated area, adequate back radiation characteristics of the support body of the heating means, and minimum shielding of the working portion or temperature sensor with respect to the radiation, an adequate thermal determination of the entire heating field is still ensured. This makes it possible to use the same temperature limiters for different heating unit sizes.

The particular end of the working portion is critical with respect to the operating precision of the temperature sensor in that it contributes to the adjustment or setting thereof, so that it has to date been assumed that said end must not be exposed to very high thermal stresses in the same way as the remaining parts of the working portion so as to avoid a disadjustment. However, according to the invention, this end, like the connecting main portion of the working section is exposed to the same thermal stressing and a disadjustment by thermal shape modifications is prevented in that the components fixed against one another for maintaining the setting are so interconnected that their connection remains substantially neutral with respect to the thermal adjustment or setting.

Thus, the end face of the temperature sensor can be directly exposed to the radiation of the heating means. This is also possible if in the vicinity of said end face is provided an adjusting member for the temperature sensor, which appropriately is constructed as an expansion rod sensor from at least two rod parts extending over the working portion and having different thermal expansion coefficients, e.g. an outer tube and an inner rod located in the latter. The adjusting member is then e.g. a pressure body held in clearance-free manner at the free end of the outer tube in the longitudinal direction thereof and on which is axially supported the inner rod and which for obtaining a thermally neutral behaviour is appropriately thread-free or fitted in such a way that its fitting connection cannot be loosened by expansion deformations. It is particularly advantageous to use an adjustment construction in accordance with patent application P 40 29 351.3=U.S. Pat. No. 5,208,574, to which reference should be made for further features, effects and advantages.

If two or more separately switchable heating circuits of the heating means are provided for the same heating field, it is appropriate that the temperature sensor engages over at least one heater or a turn of each heating circuit.

If the particular end of the temperature sensor located within the heating field roughly coincides with an associated, free terminating end of the temperature sensor, said terminating end can also have the said spacing with respect to the working periphery or can be in the indicated position with respect to the axial plane of the heating field, and has no direct connection to the facing inner circumference of the heating field. However, on the working portion of the temperature sensor there can also be a thermally, substantially nonreactive longitudinal portion, e.g., an extension rod, which supports the temperature sensor, particularly on its end remote from a switch head, with respect to the inner circumference of the support body forming the working periphery.

The outer tube of the temperature sensor can be tension or compression-loaded in the operating state, can be made from steel and/or quartz glass or the like and appropriately has over its entire length a constant cross-sections. At least one retaining body can at least partly, e.g., in the vicinity of the connection to the temperature sensor and/or the support body, be made from a thermally minimum-conducting material, such as an insulating material, and/or an electrically or thermally good conducting, optionally metallic material, with particularly suitable materials being relatively soft pressed ceramic fibrous materials, hard ceramics, steel, etc.

As a result of the inventive construction for radiant heating units having heating fields of greatly varying size it is possible to use the same temperature protection switch in the form of a closed subassembly, whose temperature sensor then extends to a varying extent into the heating field as a function of the width of the latter, but in all cases is adequate for the reliable monitoring against overheating of the entire heating field.

These and other features can be gathered from the claims, description and drawings, and the individual features, both singly and in the form of subcombinations, can be realised in an embodiment of the invention, and in other fields and can represent advantageous, independently protectable constructions for which protection is hereby claimed.

BRIEF DESCRIPTION OF THE DRAWINGS

Embodiments of the invention are described hereinafter relative to the drawings, wherein show.

DESCRIPTION OF PREFERRED EMBODIMENTS

Figure 1:
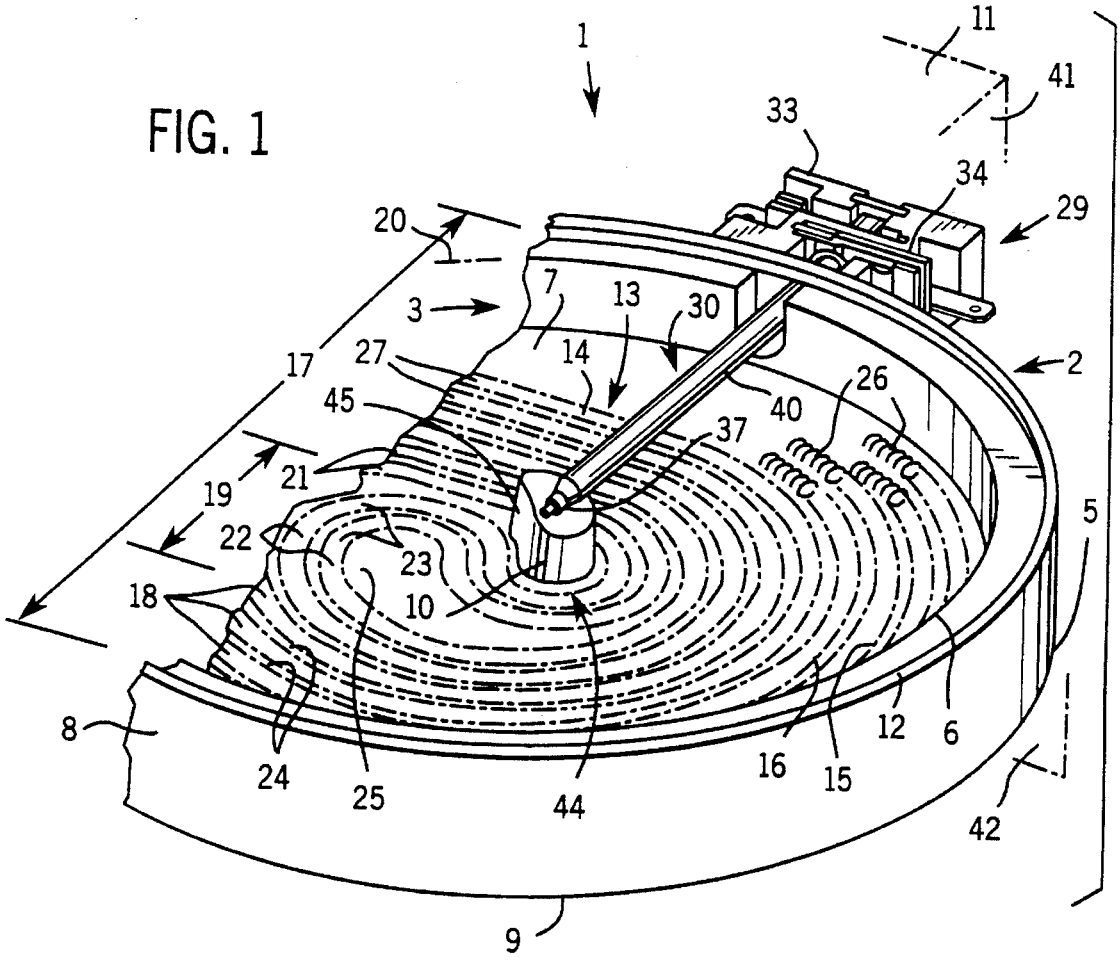
FIG. 1 is a perspective detailed view of a radiant heating unit according to the invention.

The heating unit 1 has a flat dish-shaped, substantially circular, oval kidney-shaped and/or at least monoangular support body 2, which can be symmetrical to a central axis, to at least one axial plane or non-symmetrical. The support body 2 is substantially formed by two insulators 3 and 4 and a support tray or dish 5 having the indicated shape. One of the insulators 3, which is free to the heating side, is constructed as a flat dish-shaped body, e.g., in a vacuum suction process from high temperature-resistant insulating material, which contains ceramic fibres and optionally binders, and which under the compressive loads occurring in operation is slightly resilient and/or settles and is therefore permanently deformed. Despite its inherent stability it can be compressed and pulverized with average force be%ween two fingers in the indicated cross-sections.

The insulator 3 having its insulating bottom 7 with a thickness of less than 5 mm is supported on the approximately plate-like insulator 4, which is made from a thermally better insulating, but less strong material, e.g., a loose material of microporous, pyrogenic silicic acid by compression, but in the same way as the insulator 3 can form an inherently stable body. The insulators 3 and 4 only engage with one another at part of their facing surfaces, in that the insulator 4 at a limited distance from its outer circumference has a flat projecting ring projection, which otherwise maintains a reciprocal spacing of the two insulators 3 and 4. This spacing or ring projection is approximately congruent to an insulating edge 8, which is constructed in one piece with the insulating bottom 7 and as a substantially closed rim which projects over its front by made substantially more than its thickness, which is several times the thickness of the insulating bottom 7.

The support tray 5 is substantially made in one piece from sheet metal and has a tray edge 8 approximately at right angles to the insulating bottom 7 and a multiply profiled tray bottom 9 passing ring-like around its central axis, and on which is engaged in substantially whole-surface manner the insulator 4 in such a way that its outer circumference extends up to the inner circumference of the tray rim 8, on which is engaged over virtually its entire height the insulating rim or edge 6. The noted components are equiaxial to the central axis 10 of the support body 2 and at right angles to said axis 10 on the front form a ring-like, substantially closed bearing surface 12, with which the heating unit 1 is tensioned in a bearing plane 11 resiliently against the back of a plate or the like.

Figure 2:
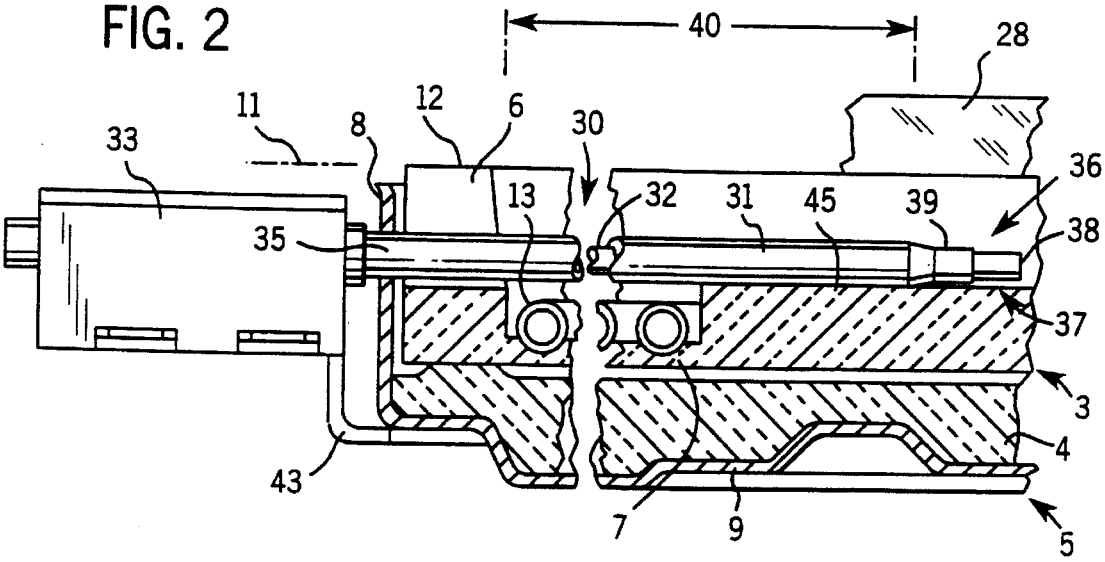
FIG. 2 is a detailed view of the unit of FIG. 1 in axial section having a slightly modified construction.

According to FIG. 1 the bearing surface 12 is formed by the tray rim 8 projecting a few millimeters over the insulating edge 6, whilst according to FIG. 2 it is formed by the insulating edge 6 projecting a few millimeters over the tray rim 8 in such a way that as a result of the resilient deformation occurring through the pressing action and the shrinkage by aging the tray rim 8 can only extend up to the bearing plane 11, but the insulating edge 6 is not flattened. Thus, the bearing surface 12 simultaneously forms a planar and resilient sealing surface constructed in one piece with the entire insulating edge 6. The spring tension for pressing purposes appropriately acts on the support tray 5 or on the tray bottom 9.

At least one heater 13 is secured in position, e.g. by embedding on the front side of the insulating bottom 7 and its heating resistor 14 can be formed by a resistance coil, a mesh of electrical resistance material, a thick-film resistor, a halogen light bulb and/or the like, as well as being exposed and substantially undarkened for the emission of its heat rays. The heating resistor 14 can be fixed e.g. by partial embedding in the insulating bottom 7. Two heating resistors 14 could form two separately switchable heating circuits 15 and 16, which are in each case substantially uniformly distributed over the entire surface of the insulating bottom, and/or at least two heating resistors are connected in parallel.

All the heating bodies 13 or the front of the insulating bottom 7 define a heating field 17, which passes from its outer circumference or working periphery 20 to the central axis 10 over most of the associated radial extension in uninterrupted manner or in substantially continuous manner with respect to its power density, and in the represented embodiment is subdivided into eight to ten approximately concentric or identically wide ring zones 18, and a central field or area 19 extending to the central axis 10 and connected to the innermost ring zone, and whose width, as a function of the heating field size, corresponds to roughly ⅓ of the total width of the heating field. In said central area 19 the surface-related, specific power density of the heating bodies 13 is smaller than in the connecting or remaining ring zones 18.

This effect results from the fact that the elongated, strand-like heaters 13 are laid in spiral turns 21 about the central axis 10, but all their free ends are as close as possible to the insulating edge 6, so that in the central area 19 with longitudinal portions spaced between their ends in each case form a S-shaped central loop 22 from in each case two pitch circular loop arcs 23. Both or all the heaters 13 in each case form directly adjacent turns 21 and central loops 22, and said turns 21 and central loops 22 with substantially constant gaps 24 are at a distance from one another which is smaller than the associated width of the particular heating resistor 14.

The innermost loop arcs 23, which form the smallest radius of curvature of the particular heating resistor 14, bound the central area 19, and in each case a central gap 25 free from heating resistors with a greatest width is much larger than that of the gaps 24, and which which passes into the associated gap 24 in curved, tapering, manner. The common axial plane of the two innermost loop arcs 23 can be located roughly in the central axis 10. The outer ends of the heating resistors 14 form connection ends 26 for the electrical connection of the heaters 13 and for this purpose are as near as possible or all approximately equally near to the inner circumference of the insulating edge 6 or all have roughly the same spacing from the central axis 10.

On the side of the central axis 10 on which said connecting ends 26 are located, the turns 21, which are otherwise curved-about the central axis 10 appropriately form less strongly curved to linear, but also parallel turn portions 27, so that here adjacent to the inner circumference of the insulating edge 6 there is a field for receiving the connecting ends 26. According to FIG. 1 this field is free from heating resistors over a relatively large surface, but the outermost turns can also be extended to the left to such an extent that said field is also substantially, or other than in the vicinity of the gaps, covered with heating resistors and the connecting ends 28 directly adjacently face the inner circumference of the insulating edge 6.

The heating unit 1 is used for the approximately sealed engagement of its bearing surface 12 on the back or underside of a translucent plate 28 made from glass ceramic material or the like, against whose back can also be applied several spaced, identical or different heating units 1, e.g. around adjacent hot plates. A temperature protection device 29 is set back in exposed manner with respect to said plate 28 or the bearing plane 11, and in particular protects the plate 28 against overheating by the heaters 13 so that said device 29 on reaching a limiting temperature automatically switches off part or the entire installed capacity of the heaters 13, and automatically switches them on again upon dropping below a lower limiting temperature.

For the determination of the temperature the area, sealed against through-flows, between the insulator 3 and the plate 28 contains a substantially contact-free, slender rod-like, linear temperature sensor 30, which has a metallic outer tube 31 forming its exposed outer circumference and with radial clearance therein for inner rod 32 made from a ceramic or similar material. One end of the outer tube 31 is longitudinally positionally secured on a casing-like base body 33 made from a hard ceramic insulating material, in which the associated end of the inner rod 32 engages in such a way that it operates a snap-action switch 34 for the capacity to be switched off and optionally a snap-action contact located behind it for a signalling device. The two other ends of the outer tube 31 and the inner rod 32 are positionally secured against one another against the associated switching or operating force by pressure engagement and/or a secured connection. If the sensor is broken or drawn off the switch 34 is operated so as to disconnect the entire or part of the power.

The base body 33 supporting in freely projecting manner the temperature sensor 30 over most of its length is positioned in spaced manner on the outside of the support body 2 or the tray rim 8 and is fixed thereto with a resilient, angular carrier 43, whose one leg is approximately parallel and contact-free adjacent to the tray rim 8, while the other leg is fixed in a positionally rigid manner to the underside of the tray bottom 9, optionally accompanied by bracing with threaded bolts or the like.

For this purpose the tray bottom 9 has, connected to its outer circumference, a shoulder displaced towards the bearing plane 11 and which is in particular ring-like, so that the carrier 43 does not project over the outside of the remaining tray bottom 9. As a result of the carrier 43 the base body 33 can perform with the temperature sensor 30 minor resilient pivoting movements about an axis in the vicinity of the tray rim 8 and/or tray bottom 9 and approximately parallel to the bearing plane 11, and at right angles to the longitudinal direction of the temperature sensor 30 and optionally also about an axis at right angles to the bearing plane 11, which greatly reduces the risk of breakage due to strong vibrations.

With the free end 36 of the temperature sensor 30 can be associated an adjusting means 37 provided for the signal contact, while the other, base-side end 35 is associated an adjusting means for the switch 34. The adjusting means 37, whose setting is made prior to the installation of the temperature sensor 30 in the heating unit 1, has an adjusting member 38 in the form of a smooth-surface bolt located on the outer circumference and which is inserted in substantially radial clearance-free manner in the associated, e.g. tapered end portion 39 of the outer tube 81, its inner end face is supported on the associated end of the inner rod 22 in all operating states and under pressure and fixed by welding in the end portion 39. The switch 34 is adjusted from the side of the base body 33 remote from the temperature sensor. Over the area in which the temperature sensor 30 is exposed to the direct radiation of the heaters 13, between said support and the other end of the inner rod 32 in the vicinity of the heating field 17, i.e. substantially from said support up to the inner circumference of the insulating edge 8, the temperature sensor 30 forms a thermally reacting working portion 40, in whose area the outer tube 31 reacts to changes of the heat radiation by length modifications. In the vicinity of the insulating edge 6, the temperature sensor 30 is shielded against said thermal radiation in that it traverses the insulating edge 6, and/or the tray edge 8, either according to FIG. 1 in the vicinity of further openings, or according to FIG. 2 in the vicinity of closely adapted bores, and is consequently centered by said edge.

The working section 40 could admittedly be roughly tangential or chord-like to one or more turns 21, but appropriately is provided approximately in an axial plane 41 of said turns or the central axis 10, which is at an angle of approximately 45° to the common axial plane of the two innermost loop arcs 23. Whereas according to FIG. 1 the connection ends 26 or their associated outermost end turns do not extend up to the axial plane 41, they can also traverse the latter, so that the working portion 40, also in said area connected to the inner circumference of the tray edge 6, is exposed to direct radiant heating.

The working portion 40 or the temperature sensor 30 at the most extends up to the associated axial plane 42 of the turns or the central axis 10 at right angles to the axial plane 41, so that it covers most of the eight to ten ring zones 18, namely in the vicinity of the turn portions 27, which are approximately parallel to the axial plane 42. The working portion 40 can also traverse the axial plane 42.

Besides being indirectly supported by means of the carrier 43, the insulating bottom 7 and the temperature sensor 80 are directly supported on one another by a mounting support 44 in the vicinity of the free end 36, and said mounting support is substantially exclusively formed by a single holding body 45 made from said the material in one piece with the insulating bottom 7. The holding body 45 is located in the central gap 25 closer to the central axis 10, or having its edges traversed by the latter, and is adjacent with only a limited gap spacing to the inner circumference of the associated innermost loop arc 28, so that in a view of the bearing plane 11 it has the described, curved, tapering shape. Its free face is spaced between the front of the heating resistor 14 and the bearing plane 11 in such a way that the temperature sensor 80 bears thereon in the vicinity of its associated end 86 under the compressive force of the pretensioned carrier 43 with a circumferential area which is smaller than ½ or ¼ of the overall circumference.

The compressive force is smaller than those deformation forces which would be necessary to bring about an elastic bending deformation of the temperature sensor 30, but larger than the curvature forces directed against the bearing plane 11 and which could occur through the thermal expansion curvature of the insulating bottom 7. The tray edge 8 is not directly influenced by these forces, if it forms with the shoulder receiving the tray bottom 9 or the carrier 43 a resilient stiffening profile for securing the position of the base body 38. The holding body 45 is located substantially completely on one side of the central axis 10 or the axial plane at right angles to the common axial plane of the loop arcs 23 and but is traversed by the axial planes 41, 42. As its outside width is tapered towards its free face and also as a result of its described arrangement, the holding body 45 does not thermally shield the temperature sensor 30 or the working portion 40, or only does so to a negligible extent with respect to the direct radiation of the heaters 13.

The hump-shaped holding body 45 is also completely contact-free with respect to the overall inner circumference of the insulating edge 8, through which the working periphery 20 of the heating field 17 is determined. The mounting support 44 is located in the vicinity of the gap between the insulator 4 and the insulating bottom 7, whose thickness roughly corresponds to the outside width of the temperature sensor 30, so that said curvature forces can be kept particularly low, and also the insulating bottom 7 can give way in an elastic resilient manner to the compressive force of the temperature sensor 30 in the vicinity of the mounting support 44.

Thus, in section through the axial plane 41, a frame-shaped stiffening union, which is slightly resilient and transversely pretensioned with respect to the insulating bottom 7 is obtained, in which is incorporated the insulating edge 6 in addition to the support tray 5, the carrier 43, the base body 33, the temperature sensor 30, the mounting support 34, the insulating bottom 7 and the insulator 4, and in it engages in resiliently movable manner at right angles to its axis and in all directions the temperature sensor 30.

In FIGS. 3 to 8 the same parts are given the same reference numerals as in FIGS. 1 and 2, but carry different letter references, so that all parts of the description also apply thereto. The mounting supports according to FIGS. 1 to 8 can be provided individually or in random combination and numbers for the same temperature sensor. In all the embodiments the support faces 49 are under the pressure of the tensioning means, i.e., the resilient carrier 43 on the insulator 7. The members 50 penetrating the insulator form a guide for the mounting support and the temperature sensor.

Figure 4:
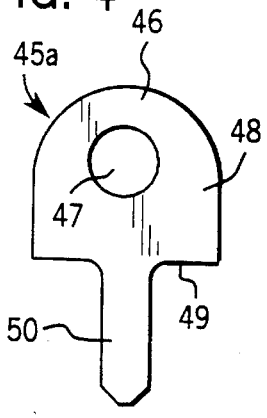
FIG. 4 is a view of the mounting support according to FIG. 3.
Figure 3:
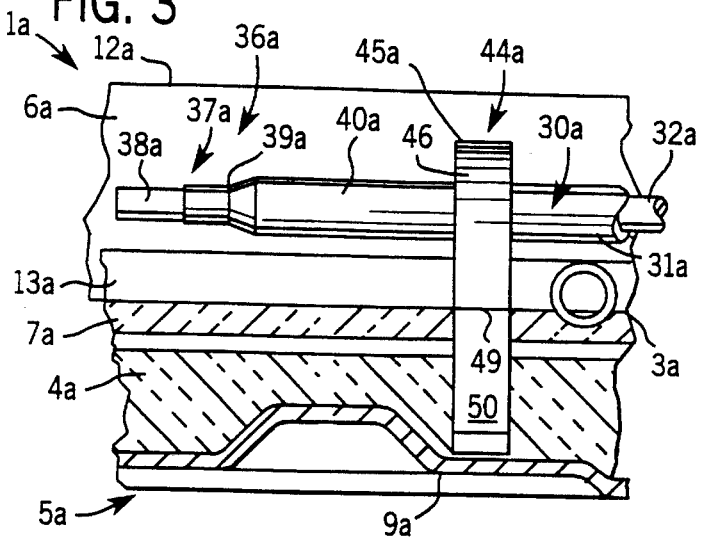
FIG. 3 is an axial section view of another embodiment in a detail, but on a much larger scale.

FIGS. 3 and 4 show a plate-like holding body 45*a* made from a hard ceramic material having a thickness roughly, corresponding to the diameter of the temperature sensor 30*a*. The holding body 45*a* forms a ring 48, which is substantially closed over the circumference and having a passage opening 47, which is only slightly wider than the outer circumference of the working portion 40*a*, so that the outer tube 31*a*, which can also be a protective tube made from quartz glass or the like which does not participate in the sensor expansions, is longitudinally displaceable with respect to the mounting support 44*a*. The ring 48 projects over the side of the working portion 40*a* remote from the heater 13*a*, but does not extend up to the bearing plane or surface 12*a*, so that it remains contact-free with respect to the plate 28.

On the other side the plate body 48 having the ring 46 has two approximately aligned shoulder or support surfaces 49, between which projects a plugging member 50 pointed at its free end. With said cross-sectionally rectangular plugging member 50, following engagement on the temperature sensor 30*a*, the holding body 45*a* can be engaged in the insulating bottom 7*a* or the insulator 4*a* accompanied by simultaneous material displacement in order to form the associated plugging opening, and so as to ensure that no turning takes place and/or can be inserted in a bore until its free end is at a limited distance from the tray bottom 9*a*. The plugging member 50 displaces the insulating material of the insulating bottom 7*a* and the insulator 4*a* both radially and parallel to the bearing surface 12*a*, as well as at right angles thereto, so that through compression correspondingly compacted insulating material is located in the vicinity of the inner circumference and the blind hole-like end 6*f* the plugging opening or plugging member 50.

The support surfaces 49 are then located in a gap 24 or a central gap 25 of the top of the insulating bottom 7*a* facing the temperature sensor 30*a*, and which in the area outside the heater 13*a* is roughly in one plane over the entire heating field 17. In the longitudinal direction of the plugging member 50, which is at right angles to the longitudinal direction of the temperature sensor 30*a* or the bearing surface 12*a*, the holding body 45*a* can perform sliding movements in the plugging opening with respect to the insulators 3*a* and 4*a*, or by corresponding, barb-like claw profiles it can be secured against such sliding movements. However, appropriately the support surfaces 49 are under all operating conditions on the insulating bottom 7*a* under the force of the pretension of the temperature sensor 30*a*, so that the latter with the holding body 45*a* forms a holding-down device for the insulating bottom 7*a*.

The working portion 40*a* extends on either side over and beyond the holding body 45*a*, so that the end 36*a* with the adjustment means 37*a* is contact-free and without shielding being exposed to the direct radiation of the heater 13*a*. The longitudinal portion of the working section 40*a* associated with the end 36*a* is shorter than that located on the other side of the holding body 45*a*.

Figure 6:
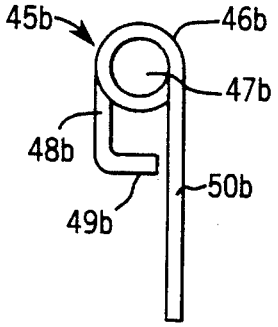
FIG. 6 is a view of a retaining member according to FIG. 5.
Figure 5:
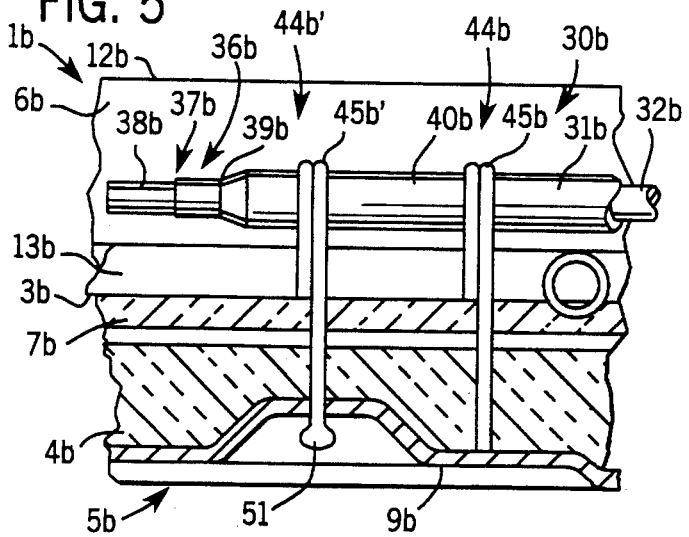
FIG. 5 is a view of another embodiment similar to the representation according to FIG. 3.
Figure 7:
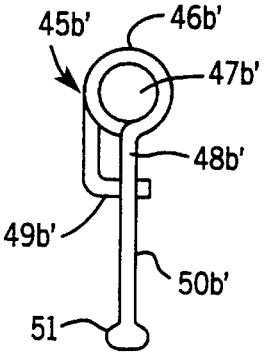
FIG. 7 is a view of another retaining member according to FIG. 5.

According to FIGS. 5 to 7 there are two holding bodies 45*b* and 45*b*' spaced from one another and provided in such a way that they engage in separate gaps 24 or central gaps 25 and between them there can be, e.g., one, two, three or four turns 21 or turn portions 27. Each holding body 45*b* or 45*b*' is exclusively formed from a curved wire piece, the ring 46*b* and 46*b*' being wound in the manner of a spiral tension spring from two closely engaging turns.

The through opening 47*b* or 47*b*' can consequently be resiliently widenable, so that the ring 46*b* or 46*b*' surrounds in radial clearance-free manner and with tension the outer circumference of the temperature sensor 30*b*. The ring 46*b* or 46*b*' is engageable from the free end 36*b* of the temperature sensor 30*b* and during engagement can be widened on a conical transition section of the tapered end portion 39*b*.

A leg of the wire 48*b* or 48*b*' tangentially directed away from the ring 46*b* is wound at its end inwards towards the facing side of the ring 46*b* and 46*b*' and consequently forms the single support surface 49*b* or 49*b*', which in a view on the bearing surface 12*b* consequently roughly coincides with the passage opening 47*b* or 47*b*'.

According to FIG. 6 the other leg is parallel to the first-mentioned leg and on the opposite side of the ring 46*b* is led away tangentially therefrom and parallel in the same direction, but for forming the plugging member 50*b* is extended beyond the support surface 49*b*. The plugging member 50*b* can extend up to engagement on the inside of the tray bottom 9*b*, so that here there is an electrical grounding connection between the temperature sensor 30*b* and the earth support tray.

The holding body 45*b* requires a wider gap, e.g., a central gap 25, while the holding body 45*b*' is suitable for a narrower gap, because in a view parallel to the passage opening 47*b*, the leg forming the plugging member 50*b*' crosses the support surface 49*b*' at a distance between its ends or roughly in the center of its length and is approximately radial to the ring. The plugging member 50*b*' also traverses the tray bottom 9*b* an the vicinity of a shoulder displaced towards the bearing surface 12*b* and optionally extending in uninterrupted, ring-like manner around the central axis 10 and through which the insulator 4*b* in this area has approximately half smaller or roughly the same plate thickness as in the vicinity of its outer circumference.

On the outside of the tray bottom 9*b*, whose shoulder forms a mating member, the plugging member 50*b*' is provided with a separate securing member 51 or such a securing member constructed in one piece therewith, and which with respect to the passage opening in the shoulder is wider and which can, e.g., be formed by deformation, such as the bending of the plugging member 50*b*'. As a result of this securing member 51, the holding body 45*b*' is positively secured against pulling out and the member is held down with respect to the sheet metal tray bottom. The particular holding member can also perform slight tilting movements in the transverse and/or longitudinal direction of the temperature sensor 30*b*.

The completely flush securing member 51 or the entire holding body does not project over the underside of the heating unit 1*b* or the tray 5*b*, and with the underside forms a stacking surface for the superimposed stacked storage of the heating units.

Figure 8:
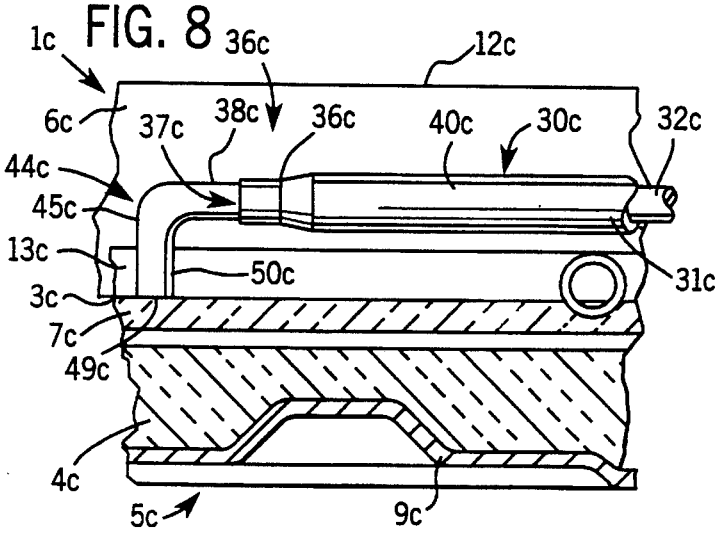
FIG. 8 is a view of another embodiment in a view similar to that of FIG. 3.

Instead of being located on the outer circumference, the holding body 45*c* according to FIG. 8 is located on an inner circumference, namely that of the outer tube 31*c* or the end portion 39*c*, so that the outer circumference of the entire working portion 40*c* can be completely exposed. The holding body 45*c* is formed by a bending-stiff, non-resilient and bent bolt or rod, whose one leg is inserted from the free end into the outer tube 31*c* and can be constructed in one piece with the adjusting member 38*c* or the inner rod 32*c*. The other leg forms a support member 50*c*, which can be constructed in the same way as the above-described plugging member, but in this case forms with its free end face the support face 49*c*, and does not engage in the insulating bottom 7*c*. The freely projecting length of the leg roughly equiaxial to the temperature sensor 30*c* is roughly the same as the external diameter of the cylindrical temperature sensor 30*c* or the length of the support member 50*c*.

The holding body could also be constructed in multipart form and/or from different materials, but is appropriately in one piece throughout, which leads to a very simple construction. For reducing the shielding action of the ring, its passage opening can be significantly wider than the temperature sensor and have merely individual, circumferentially distributed, projecting members for supporting the temperature sensor. The plugging member 50*b* or 50*b*' could also be provided with a pushed on insulating bead, which would be supported on the one hand on the ring and on the other on the insulating bottom, so that there would be no need for a separate support leg.

We claim:

1. A radiant heating unit (1) comprising:

a support body (2) having a front face defining a front side;

a radiant heater spaced apart from said front face, the radiant heater and front face defining a sealed area adjacent the front side;

at least one heating field (17) defined by said front face, said heating field (17) being provided for emitting operational heat away from said front face;

a temperature sensor (30), and mounting means (43) for holding said temperature sensor (30) with respect to said support body (2) said mounting means located outside said sealed area, and a tensioning means for pressing said temperature sensor (30) against said support body within said sealed area, said temperature sensor extending from outside said sealed area to inside said sealed area.

2. The temperature sensor according to claim 1, wherein on said front side and at a distance from said front face said support body (2) provides a bearing face (12) for supporting a plate member (28) with respect to said heating unit (1), said bearing face (12) projecting over said front face, said temperature sensor (30) having a first length section (35) for mounting said temperature sensor with respect to said support body (2), said temperature sensor (30) providing a second length section (36) at a distance from said first length section (35), said tensioning means pressing said second length section (36) in a direction away from said bearing surface and against said front face of said support body (2) within said heating field (17).

3. A radiant heating unit (1) comprising:

a support body (2) having a front face defining a front side;

a radiant heater spaced apart from said front face, the radiant heater and front face defining a sealed area adjacent the front side;

at least one heating field (17) defined by said front face, said heating field (17) being provided for emitting operational heat away from said front face;

a rod sensor member (30) at least partially located in said sealed area; and mounting means (43) for holding said rod sensor member (30) with respect to said support body (2), and a tensioning means for pressing said rod sensor member (30) against said support body (2), when seen in plan view on said heating field (17), said mounting means (43) holding said rod sensor member (30) outside said sealed area, and in said plan view said tensioning means pressing said rod sensor member (30) against said support body (2) within said sealed area, said rod sensor member extending from outside said sealed area into said sealed area.

4. A radiant heating unit with a support body having a bearing surface bearing on a plate when assembled, the plate transmitting heat and the plate and support body defining a sealed area, the unit further comprising at least one radiant heater spaced from the bearing surface, said at least one radiant heater providing radiant heat which defines at least one heating field, said radiant heating unit further comprising a temperature limiter which has a temperature limiting head and a rod like temperature sensor exposed at least partially inside the sealed area, the temperature sensor extending from outside the sealed area into the sealed area, said radiant heating unit further comprising a mounting support for a portion of the temperature sensor and an associated tensioning means, said tensioning means urging an area of the temperature sensor remote from the temperature limiting head in a direction directed away from the bearing surface and pressed against a central portion of the support body by means of the mounting support.

5. The radiant heating unit according to claim 4, wherein the temperature sensor has an end located within the heating field and a spacing from a plate plane defined by the bearing surface and the heater.

6. The radiant heating unit according to claim 4, wherein the tensioning means are formed by a resilient carrier of the temperature limiter.

7. The radiant heating unit according to claim 4, wherein the tensioning means comprise a tie rod resiliently connected to the support body.

8. The radiant heating unit according to claim 4, wherein the mounting support contains a bearing surface for the transfer of the pressure of the tensioning means to an insulator located in the support body and a guide in the insulator.

9. The radiant heating unit according to claim 4, wherein, between the mounting support located in the vicinity of the end remote from the temperature limiter and the switch head, the temperature sensor has no intermediate support.

10. The radiant heating unit according to claim 4, wherein the support body, the temperature limiter with its carrier and the temperature sensor, and the mounting support form a non an open frame.

11. A radiant heating unit with a support body having a bearing surface for bearing on a plate for transmitting heat, the unit further comprising at least one radiant heater spaced from the bearing surface, said at least one radiant heater providing radiant heat which defines at least one heating field, said radiant heating unit further comprising a temperature limiter which has a temperature limiting head and a rod-like temperature sensor exposed to the temperature of the radiant heater, said radiant heating unit further comprising a mounting support for a portion of the temperature sensor and an associated tensioning means, the mounting support comprising a projection of a heater carrying insulator, said tensioning means urging an area of the temperature sensor remote from the temperature limiting head in a direction directed away from the bearing surface and pressing against the support body by means of the mounting support.

12. The radiant heating unit according to claim 11, wherein the projection is located in an unheated central zone of the support.

13. A radiant heating unit with a support body having a bearing surface for bearing on a plate, the plate transmitting heat, when assembled the plate and support body defining a sealed area, the unit further comprising at least one radiant heater spaced from the bearing surface, said at least one radiant heater providing radiant heat which defines at least one heating field adjacent said plate, said radiant heating unit further comprising a temperature limiter which has a temperature limiting head and a rod-like temperature sensor exposed to the temperature of the radiant heater, said radiant heating unit further comprising a mounting support for a portion of the temperature sensor and an associated tensioning means, the temperature sensor end located within the sealed area is provided with an adjusting means, said adjusting means acting directly between a sleeve and an inner rod of the temperature sensor, said tensioning means urging an area of the temperature sensor remote from the temperature limiting head in a direction directed away from the bearing surface and pressing against the support body by means of the mounting support.

14. The radiant heating unit according to claim 13, wherein the adjusting means contains a connection which cannot be released after adjustment has taken place.

15. The radiant heating unit according to claim 13, wherein the adjusting member forms the mounting support.

16. A radiant heating unit with a support body having a bearing surface for bearing on a plate, the plate transmitting heat, the unit further comprising at least one radiant heater spaced from the bearing surface, said at least one radiant heater providing radiant heat which defines at least one heating field adjacent said plate, said radiant heating unit further comprising a temperature limiter which has a temperature limiting head and a rod-like temperature sensor exposed to the temperature of the radiant heater, said radiant heating unit further comprising a mounting support for a portion of the temperature sensor and an associated tensioning means, said tensioning means urging an area of the temperature sensor remote from the temperature limiting head in a direction directed away from the bearing surface and pressing against the support body by means of the mounting support, wherein the temperature sensor is dimentioned in such a way that the stressing by the tensioning means causes no function-reducing deformations in the temperature sensor, the temperature sensor being an expansion sensor.

17. A radiant heating unit with a support body having a bearing surface for bearing on a plate, the plate transmitting heat, the unit further comprising at least one radiant heater spaced from the bearing surface, said at least one radiant heater providing radiant heat which defines at least one heating field, said radiant heating unit further comprising a temperature limiter which has a temperature limiting head and a rod-like temperature sensor exposed to the temperature of the radiant heater, said radiant heating unit further comprising a mounting support for a portion of the temperature sensor and an associated tensioning means, temperature limiters having the same length provided for heating units of different sizes, said tensioning means urging an area of the temperature sensor remote from the temperature limiting head in a direction directed away from the bearing surface and pressing against the support body by means of the mounting support.

* * * * *

UNITED STATES PATENT AND TRADEMARK OFFICE

CERTIFICATE OF CORRECTION

PATENT NO. : 5,489,764

DATED : February 6, 1996

INVENTOR(S) : Mannuss, Siegfried et al.

It is certified that error appears in the above-identified patent and that said Letters Patent is hereby corrected as shown below:

Column 1, line 19, after "e.g.", insert --,--.

Column 1, line 49 after rod, insert --,--.

Column 2, line 34, "providing a radiant" should be --providing radiant--.

Column 2, line 34, "units" should be --unit--.

Column 3, line 5, "Said" should be --said--.

Column 3, line 47, "behaviour" should be --behavior--.

Column 4, line 9, "length a constant" should be --length constant--.

Column 4, line 9, "cross-sections" should be --cross-section--.

Column 4, line 27, "realised" should be --realized--.

Column 4, line 35, delete "show".

Column 4, line 41, delete "a".

Column 4, line 67, "fibres" should be --fibers--.

Column 5, line 4, "be%ween" should be --between--.

Column 5, line 18, "8" should be --6--.

Column 5, line 20, "made substantially" should be --significantly--.

UNITED STATES PATENT AND TRADEMARK OFFICE

CERTIFICATE OF CORRECTION

PATENT NO. : 5,489,764

DATED : February 6, 1996

INVENTOR(S) : Mannuss, Siegfried et al.

It is certified that error appears in the above-identified patent and that said Letters Patent is hereby corrected as shown below:

Column 5, line 23, "substantially made" should be --made substantially--.

Column 5, line 27, after "in" insert --a--.

Column 5, line 39, "whilst" should be --while--.

Column 5, line 60, after "bottom" insert --7--.

Column 6, line 16, "a" should be --an--.

Column 6, line 16, after "22" insert --,--.

Column 6, line 27, after "width" insert --which--.

Column 6, line 28, delete "which".

Column 6, line 29, delete ",".

Column 6, line 34, delete "all".

Column 6, line 47, "28" should be --26--.

Column 7, line 1, after "for" insert --an--.

Column 7, line 25, after "11" insert --,--.

Column 7, line 43, after "circumference" insert --,--.

Column 7, line 44, after "e.g." insert --,--.

Column 7, line 45, "81" should be --31--.

Column 7, line 46, "is" should be --being--.

UNITED STATES PATENT AND TRADEMARK OFFICE

CERTIFICATE OF CORRECTION

PATENT NO. : 5,489,764

DATED : February 6, 1996

INVENTOR(S) : Mannuss, Siegfried et al.

It is certified that error appears in the above-identified patent and that said Letters Patent is hereby corrected as shown below:

Column 7, line 47, "is" should be --being--.

Column 7, line 53, after "i.e." insert --,--.

Column 7, line 54, "8" should be --6--.

Column 7, line 60, delete ",".

Column 8, line 16, "80" should be --30--.

Column 8, line 18, "said" should be --the--.

Column 8, line 20, delete "the".

Column 8, line 25, "28" should be --23--.

Column 8, line 29, "80" should be --30--.

Column 8, line 30, "86" should be --36--.

Column 8, line 42, "38" should be --33--.

Column 8, line 45, after "23" insert --,--.

Column 8, line 45, "," should be --and--.

Column 8, line 53, "8" should be --6--.

Column 9, line 17, delete ",".

Column 9, line 19, "48" should be --46--.

Column 9, line 26, "48" should be --46--.

UNITED STATES PATENT AND TRADEMARK OFFICE

CERTIFICATE OF CORRECTION

PATENT NO. : 5,489,764

DATED : February 6, 1996

INVENTOR(S) : Mannuss, Siegfried et al.

It is certified that error appears in the above-identified patent and that said Letters Patent is hereby corrected as shown below:

Column 9, line 46, "6f" should be --of--.

Column 10, line 41, after "9b" insert --in--.

Column 10, line 41, delete "the".

Column 12, line 22, after "rod" insert -- - --.

Column 12, line 47, delete ",".

Column 12, line 53, delete "a non".

Column 14, line 28, after "length" insert --are--.

Signed and Sealed this

First Day of October, 1996

*Attest:*

Bruce Lehman

BRUCE LEHMAN

*Attesting Officer*

*Commissioner of Patents and Trademarks*